United States Patent [19]

Carey, Jr. et al.

[11] Patent Number: 4,621,605

[45] Date of Patent: Nov. 11, 1986

[54] POSITIVE DISPLACEMENT FUEL INJECTION SYSTEM

[75] Inventors: Alfred W. Carey, Jr.; Lester L. Peters, both of Columbus, Ind.

[73] Assignee: Cummins Engine Company, Inc., Columbus, Ind.

[21] Appl. No.: 567,180

[22] Filed: Dec. 30, 1983

[51] Int. Cl.[4] ..... F02M 39/00

[52] U.S. Cl. ..... 123/446; 123/447; 123/451; 123/502

[58] Field of Search ..... 123/446, 447, 501, 502, 123/500, 458, 450, 451; 417/462

[56] References Cited

U.S. PATENT DOCUMENTS

| | | | |
|---|---|---|---|
| 1,991,586 | 2/1935 | Vincent | 123/445 |
| 2,863,825 | 12/1958 | Engel | 208/138 |
| 2,997,994 | 8/1961 | Falberg | 123/447 |
| 3,544,008 | 12/1970 | Reiners et al. | 239/90 |
| 3,577,765 | 5/1971 | Bertoglio et al. | 374/24 |
| 3,847,510 | 11/1974 | Fenne | 417/293 |
| 3,855,982 | 12/1974 | Brinkman | 123/495 |
| 3,951,117 | 4/1976 | Perr | 123/496 |
| 4,092,264 | 5/1978 | Tsang et al. | 252/188.28 |
| 4,249,499 | 2/1981 | Perr | 123/503 |
| 4,281,792 | 8/1981 | Sisson | 123/502 |
| 4,396,151 | 8/1983 | Kato | 123/446 |
| 4,428,346 | 1/1984 | Hoshi | 417/462 |
| 4,445,822 | 5/1984 | Hoshi | 123/462 |
| 4,463,725 | 8/1984 | Laufer | 123/446 |

FOREIGN PATENT DOCUMENTS

| | | | |
|---|---|---|---|
| 0087119 | 8/1983 | European Pat. Off. | 123/450 |
| 2067680 | 7/1981 | United Kingdom | 123/450 |

*Primary Examiner*—Carl Stuart Miller

*Attorney, Agent, or Firm*—Sixbey, Friedman & Leedom

[57] ABSTRACT

A positive displacement fuel injection system for use with a combustion engine including a fuel pump (10,10') which forms and delivers pre-metered slugs of fuel and timing fluid to unit injectors (300,300') associated with the engine combustion chambers. The pre-metered slug of timing fluid has a prescribed volume and sets the timing advance for the unit injector. The fuel pump can vary the size of the pre-metered slugs of fuel and timing fluid on a cycle-by-cycle basis.

11 Claims, 8 Drawing Figures

POSITIVE DISPLACEMENT FUEL INJECTION SYSTEM

TECHNICAL FIELD

The present invention relates generally to to fuel injection systems for internal combustion engines and, particularly, to fuel injection systems in which the timing of fuel injection may be varied in response to changing engine conditions.

BACKGROUND ART

The design of a commercially competitive fuel injection system normally involves acceptance of some characteristics which are less than optimal since the basic goals of low cost, high performance and reliability are often in direct conflict. For example, distributor-type fuel injector systems having a single centralized high pressure pump and a distributor valve for metering and timing fuel flow from the pump to each of a plurality of injection nozzles, such as disclosed in U.S. Pat. No. 3,577,765, are less expensive to construct than are other types of injection systems. However, distribution-type systems are not as reliable in operation as other types of systems due to unpredictable/uncontrollable behavior of high pressure fluids within the fluid line connecting the centralized high pressure fuel pump to the individual injector nozzles. Many of the drawbacks associated with distributor-type systems can be overcome by providing an individual cam operated unit injector at each engine cylinder location, such as illustrated in U.S. Pat. No. 3,544,008, whereby only low pressure fuel needs to be supplied to each injector, since the high pressure pressure necessary for injection can be supplied by the cam actuated pump located in the injector immediately adjacent the engine cylinder. However, unit injector systems suffer substantially higher manufacturing costs as compared with distributor type systems.

Commercially competitive fuel injector systems of the future will almost certainly need some capacity for controlling the timing of injection in response to changing engine conditions in order to achieve acceptable pollution abatement and fuel efficiency. However, high pressure distributor-type systems are probably inherently incapable of achieving the high degree of accuracy required and unit injectors which are provided with variable timing capability have invariably been highly complex and costly.

U.S. Pat. Nos. 2,997,994 and 2,863,438 provide examples of attempts to solve this dilemma by disclosing a fairly simple mechanism for achieving variable timing in unit injectors. In particular, these patents disclose the use of a collapsible hydraulic link to selectively change the effective length of the cam operated fuel injector plunger. However, the simplicity of these hydraulic timing controls is only achieved by operating the hydraulic link in either a fully expanded or fully collapsed mode. Thus, there can only be a stepped change in timing of the injection event which will not necessarily suit the broad range of conditions normally encountered during the operation of the engine. Attempts to provide for infinite variations in injection timing, even when a hydraulic link is employed, have generally involved the use of a rack mechanically connected to each injector in a manner to control the size and/or the point of collapse of the hydraulic link. Examples of such hydraulic/mechanical systems are disclosed in U.S. Pat. Nos. 3,847,510 and 4,092,264.

Independent control of fuel injection timing and quantity is critical to the achievement of highly efficient, non-polluting operation of a fuel injected internal combustion engine. However, such control must not sacrifice reliability and economy. U.S. Pat. Nos. 4,249,499 and 3,951,117 disclose fuel injectors which attempt to achieve independent control over injection timing and quantity. Each of these patents discloses an example of pressure/time unit injectors which respond to a hydraulic variable pressure signal to control injector timing. While useful for the purposes intended, the injectors disclosed in U.S. Pat. Nos. 4,249,499 and 3,951,117 do not entirely separate the timing and fuel metering functions or are too complex to achieve the desired level of low cost and reliability. For example, in U.S. Pat. No. 3,951,117 the variable timing chamber and variable metering chamber of the disclosed injector are separated only by a fixed length shuttle piston whose movement in response to change in the volume of one chamber may cause an immediate effect in the volume and/or pressure of fluid in the other chamber. The system disclosed in U.S. Pat. No. 4,249,499 discloses an infinitely variable timing system but achieves this result by provision of a fairly complex structure including a timing chamber, a pair of spring biased piston elements and external fittings located outside of the conventional injector body. Such a system could add significantly to the cost of a commercial injector.

Some attempts have been made to improve unit injector systems by having the fuel metering function performed by a centrally located fuel pump such as disclosed in U.S. Pat. No. 1,991,586 to Vincent which discloses a fuel injection system for a compression ignition engine including a plurality of cam operated pump units for injecting fuel into corresponding combustion cylinders combined with a variable stroke fuel pump (FIGS. 5 and 6) for displacing a controlled quantity of fuel into a common rail connected to all of the cam operated injectors in sequence just before each injector reaches its injection period. Although not specifically discussed, the Vincent patent states that it may in certain instances be desirable to advance or retard the beginning of injection and such may be "attained in any well known manner", page 6, left hand column, lines 57–62. The high pressure existent in the supply lines connecting the fuel pump with the cam operated units would, however, appear to subject the Vincent system to the same type of high pressure drawbacks as discussed above with respect to distributor type injection systems.

U.S. Pat. No. 3,855,982 to Brinkman discloses an injection system including reciprocating plungers for supplying metered quantities of fuel to injector nozzles associated with each cylinder of an internal combustion engine wherein the stroke length of each pump plunger may be adjusted by mechanical stops in order to control the quantity of fuel delivered to each combustion chamber. The reciprocating movement of the plungers is brought about by fluid pressures. But the Brinkman patent fails to disclose a variable timing control for the disclosed system.

In short, the prior art has failed to show how to achieve highly accurate control over injection timing in a cost competitive fuel injection system.

DISCLOSURE OF THE INVENTION

It is a main object of the present invention to provide a novel and improved variable timing fuel injection system for intermittently injecting fuel into the combustion chamber of a cyclically operating internal combustion engine. The variable timing fuel injection system comprises a fuel supply for providing a supply of liquid fuel at low pressure, an injector adapted to be mounted adjacent the combustion chamber of the internal combustion engine with the injector being fluidically connected with the fuel supply for receiving fuel from the fuel supply and for cyclically injecting fuel under high pressure into the combustion chamber. The injector includes a timing fluid receiving system for controlling the timing of fuel injection during engine operation in dependence upon the volume of timing fluid slugs received by the injector means. A timing slug forming pump is adapted to be mounted remote from the injector for metering slugs of timing fluid and for delivering each pre-metered slug of timing fluid to the injector prior to the commencement of injection of fuel whose timing is to be controlled.

It is another object of the present invention to provide a novel and improved fuel injection system for association with a combustion chamber of a combustion engine in which sophisticated timing advance mechanisms are not required, yet fuel injection timing advance can be altered on a cycle-by-cycle basis to accurately and reliably set fuel injection timing. The fuel injection system includes a fuel pump which forms and delivers pre-metered slugs of timing fluid and a unit injector associated with the fuel pump and which is adapted to deliver fuel to an engine combustion chamber in accordance with timing of engine operation and in accordance with a timing advance which is dependent on the size of the pre-metered slugs of timing fluid delivered by the fuel pump. The fuel injection system includes control means for controlling timing of fuel injection to the combustion chamber and providing the capability of varying such timing of fuel injection on a cycle-by-cycle basis using the pre-metered slugs of timing fluid delivered to the unit injector.

It is another object of the present invention to provide a novel and improved fuel injection system for use with a combustion engine having at least one combustion chamber in which a fuel pump forms and delivers low pressure pre-metered slugs of fuel and timing fluid to a unit injector associated with the combustion chamber which receives the pre-metered slugs when that unit injector is in a slug receiving mode. Each pre-metered slug has a specified volume which can be altered by the fuel pump on a cycle-by-cycle basis with the amount of fuel injected at high pressure to the combustion chamber by the unit injector and the timing of that injection on a cycle-by-cycle basis being a function of the volume of the pre-metered slug received by the unit injector in each cycle so the amount of and timing of fuel injected by the unit injector is variable on a cycle-by-cycle basis, yet is accurate and precise.

It is another object of the present invention to provide a novel and improved fuel injection system for use with a combustion engine which includes a positive displacement fuel pump for accurately and precisely forming and delivering pre-metered slugs of fuel and timing fluid to a unit injector associated with each combustion chamber of the combustion engine. The fuel pump includes a piston and an adjustment control means for adjusting the stroke of that piston for forming and delivering quantities of fuel and timing fluid in the form of pre-metered slugs. The adjustment control means can be electrical, mechanical, hydraulic or a combination thereof and can be set according to engine operation. A plurality of unit injectors can be used, and the fuel pump is fluidically connected to each unit injectors by a common rail.

It is another object of the present invention to provide a novel and improved fuel injection system for use with a combustion engine which includes a unit injector associated with each combustion chamber of the combustion engine which receives fuel and timing fluid only when in a receiving mode. Each unit injector of the fuel injector system thus provides a valving/distributing function. The valving/distributing function may be organized so that only a single common rail is necessary for delivering and timing and fuel slugs to all of the unit injectors associated with an engine. Each unit injector includes a cam operated injection plunger which is mechanically coupled to the engine to operate in timed relation with the reciprocal motion of the engine piston with which the unit injector is associated. Each unit injector further includes a timing piston which is coupled to the injection plunger by a lost-motion coupler so that the injection plunger is mechanically coupled to the timing piston. Fuel is delivered by the unit injector only after pre-metered slugs of timing fluid and fuel have been received by the unit injector and only after the injection plunger is associated with the timing piston by a hydraulic link formed by the slug of timing fluid so that the beginning of fuel injection is set by the size of the pre-metered slug of timing fluid. Grooves and ports defined in the unit injector determine the beginning of the unit injector fuel and timing receiving mode, and the end of injection.

These and other objects are accomplished by the fuel injection system of the present invention which includes a fuel pump having a positive displacement fuel slug forming means and a positive displacement timing fluid slug forming means. The volumes of the slugs formed by these slug forming means are controlled by an adjustment means which is variable on a cycle-by-cycle basis.

BEST MODE FOR CARRYING OUT THE INVENTION

Figure 1:
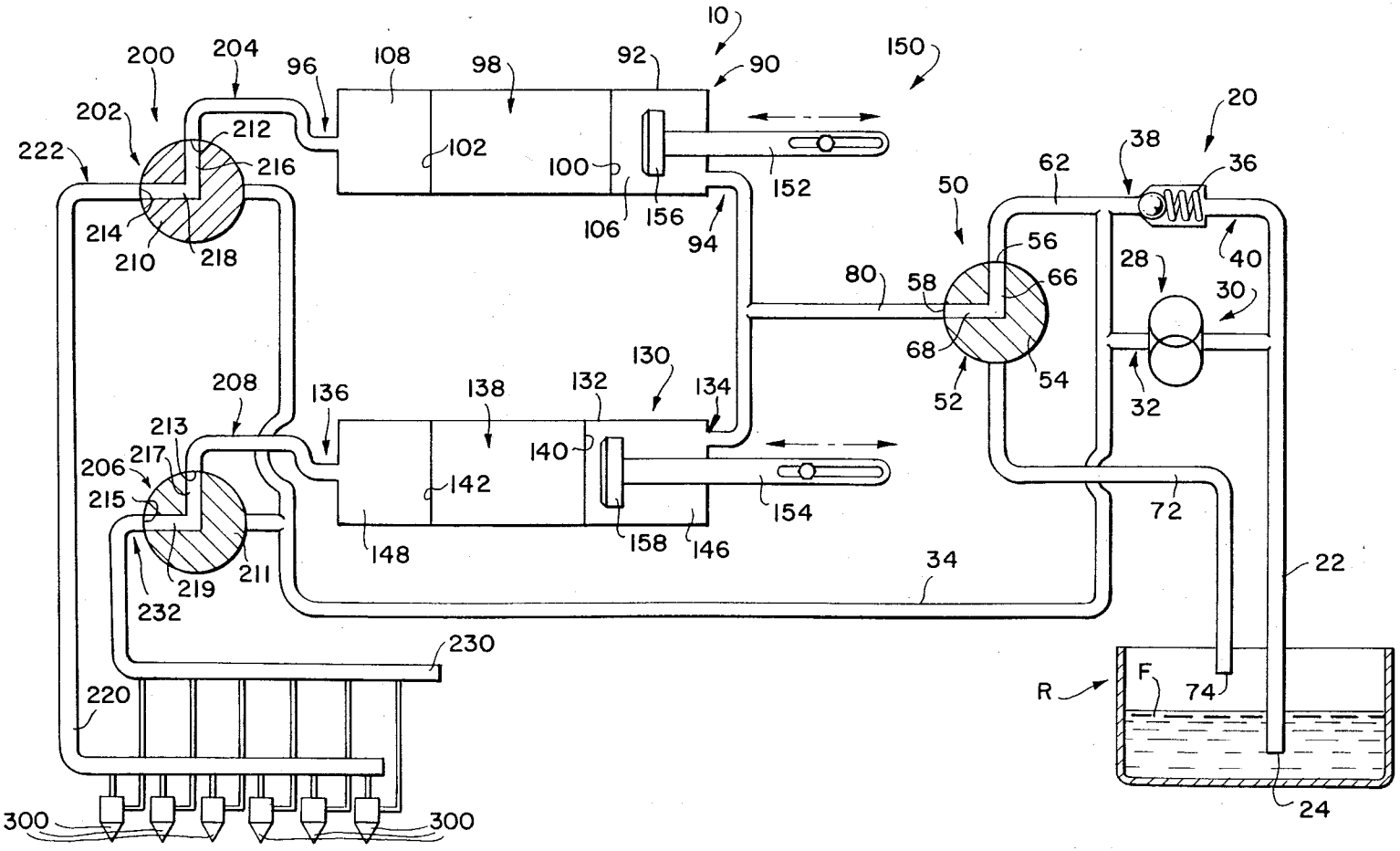
FIG. 1 is a schematic view of a fuel injection system embodying the present invention including a pair of positive displacement pumps and a pair of common rails for connecting the pumps with the unit injectors.

Referring to FIG. 1, there is shown a fuel pump 10 for use with an internal combustion engine having a fuel reservoir R, and a plurality of engine cylinders containing reciprocating engine pistons (not illustrated). The fuel injection system of the present invention sets and controls the timing of fuel injection into each cylinder so the beginning of such fuel injection can be varied on a cycle-by-cycle basis with respect to the reciprocating motion of the engine piston contained in the engine cylinder into which the fuel is being injected.

The fuel pump 10 includes a fuel supply means 20 for withdrawing fuel F from the reservoir R. The fuel supply means 20 includes a supply pipe 22 which has an inlet end 24 positioned within the reservoir R. A constant delivery pump 28 has an inlet 30 fluidly connected to the supply pipe 22 and an outlet 32 fluidly connected to a supply line 34 which is also fluidly connected to a pressure relief valve 36 via pressure relief valve inlet 38. The pressure relief valve 36 maintains a set pressure within the fuel pump 10 and has an outlet 40 fluidly connected to the supply pipe 22. The pressure set by valve 36 may be at a relatively low level with respect to the very high pressures normally required for fuel injection.

The fuel pump 10 includes a first fuel flow control means 50 for controlling flow from the fuel supply means 20 to the remainder of the fuel pump 10. The first fuel flow control means 50 includes a three-way valve 52 having a movable valve body 54 with inlet port 56 and outlet port 58 defined therein. In the orientation shown in FIG. 1 for the valve body 54, port 56 is fluidly connected to supply line 34 by an inlet conduit 62 to receive fuel delivered by constant delivery pump 28. The valve body 54 includes valve passages 66 and 68 defined therein to fluidly connect inlet port 56 and outlet port 58 in a first orientation, shown in FIG. 1, and to fluidly connected outlet port 58 to a dump line 72 in a second orientation. As will be understandable from the discussion below, the first orientation of valve body 54 is a slug delivering orientation and the secod orientation of the valve body 54 is a slug forming orientation for the fuel pump 10. The dump line 72 has an outlet 74 positioned in the reservoir R to deliver fuel to reservoir R. A conduit 80 is connected to the valve body 54 to be in fluid communication with outlet port 58 in the slug delivering configuration of the first fuel flow control means 50 to receive fuel from the fuel supply means 20, and to be in fluid communication with inlet port 56 when the flow control means 50 is in the slug forming configuration to deliver fuel back to reservoir R via dump line 72.

A positive displacement fuel slug forming means 90 includes a housing 92 having an inlet 94 fluidly connected to conduit 80, and an outlet 96. A fuel piston 98 is movably positioned within the housing 92 to have a first end 100 in fluid communication with inlet 94, and a second end 102 in fluid communication with outlet 96. The piston first end 100, together with housing 92, forms a fuel receiving chamber 106, and piston second end 102, together with housing 92, defines a fuel slug forming and delivering chamber 108. Fuel received in chamber 106 from the fuel supply means 20 and first fuel flow control means 50 tends to move fuel piston 98 toward outlet 96 in a fuel slug delivery process, and fuel received in chamber 108 tends to move fuel piston 98 toward inlet 94 during a slug forming process.

Due to the positive displacement nature of the slug forming-means 90, fluid is received and delivered by that slug forming means 90 in discrete slugs of set volume. These discrete slugs of fuel are termed pre-metered fuel slugs, and have volumes which are precisely and accurately metered and set by the size of chamber 108 of fuel slug forming means 90.

The fuel pump 10 also includes a positive displacement timing fluid slug forming means 130 for forming and delivering timing fluid slugs of predetermined volume. The timing fluid slug forming means 130 includes a housing 132 having an inlet 134 fluidly connected to conduit 80, and an outlet 136. A timing fluid piston 138 is movably positioned within the housing 132 to have a first end 140 in fluid communication with inlet 134, and a second end 142 in fluid communication with outlet 136. A fuel receiving chamber 146 is defined in the housing 132 adjacent to piston first end 140, and a timing fluid forming and delivering chamber 148 is defined by piston second end 142 and the housing 132. Fuel received in chamber 146 from the fuel supply means 20 and first fuel flow control means 50 tends to move timing fluid piston 138 toward outlet 136 in a timing fluid slug delivery process, and fuel received in chamber 148 tends to move timing fluid piston 138 toward inlet 134 during a timing fluid slug forming process.

Due to the positive displacement nature of the timing fluid slug forming means 130, fluid is received and delivered by the timing fluid slug forming means 130 in discrete slugs each of which has a prescribed volume. These discrete slugs may be termed pre-metered timing fluid slugs and have volumes which are accurately and precisely metered and set by the volume of chamber 148, with this volume, in turn, being set by the stroke length of timing fluid piston 138.

The stroke length of pistons 98 and 138 is set by an adjustment control means 150 for varying the volume of the fuel and timing fluid slugs on a cycle-by-cycle basis during operation of the internal combustion engine with which fuel pump 10 is associated. The adjustment control means 150 includes a fuel movable stop arm 152 and a timing fluid movable stop arm 154 attached to a suitable control mechanism (not shown), and head stops 156 and 158 located in fluid receiving chambers 106 and 146 to abut piston first ends 100 and 140 for setting stroke length of pistons 98 and 138. The control mechanism associated with adjustment control means 150 can be mechanical, electrical, hydraulic, or the like, and is adaptable to adjustment on a cycle-by-cycle basis to thereby control the pre-metered volume of the fuel and timing fluid slugs formed and delivered by the fuel slug forming means 90 and the timing fluid slug forming means 130 on a cycle-by-cycle basis. The fuel movable stop arm 152 can be adjusted and controlled independently of the timing fluid stop movable arm 154, to permit independent control of fuel metering and timing as is required to achieve optimum engine performance over a wide range of engine operating conditions.

The fuel pump 10 further includes a second fuel flow control means 200 which includes a first three way flow control valve 202 fluidly connected to the fuel slug forming means outlet 96 by a conduit 204, and a second three way flow control valve 206 fluidly connected to the timing fluid slug forming means outlet 136 by a conduit 208. Three way flow control valves 202 and 206 include movable valve bodies 210 and 211 having inlet ports 212 and 213 and outlet ports 214 and 215 defined therein, respectively. The inlet and outlet ports of the three way flow control valves are fluidly connected together by passages 216, 217, 218 and 219, respectively, defined in valve bodies 210 and 211. In the FIG. 1 orientation of fuel pump 10, inlet ports 212 and 213 of the second fuel flow control means 200 are fluidly connected with conduits 204 and 208 to receive pre-metered slugs from the fuel slug forming means 90 and from the timing fluid slug forming means 130, respectively, when the fuel pump 10 is in a slug delivery mode. The valve bodies 210 and 211 are movable from the FIG. 1 slug delivery mode configuration into a configuration in which the outlet ports 214 and 215 of the second fuel flow control means 200 are fluidly connected with conduits 204 and 208 and the inlet ports 212 and 213 are fluidly connected with supply line 34 to be connected to the fuel supply means 20 to receive fuel from the fuel supply means 20 so that fuel flows into chambers 108 and 148 when the fuel pump 10 is in a slug forming mode.

A fuel common rail 220 has an inlet 222 fluidly connected to first flow control valve 202 of the second fuel flow control means 200 to receive pre-metered slugs of fuel when valve outlet 214 of the valve body 210 is aligned with common rail inlet 222 when the fuel pump 10 is in a slug delivery configuration. A timing fluid common rail 230 has an inlet 232 fluidly connected to outlet 215 of flow control valve 206 of the second fuel flow control means 200 to receive pre-metered slugs of timing fluid when valve outlet 215 of the valve body 206 is aligned with common rail inlet 232 when fuel pump 10 is in a slug delivery configuration.

In operation, fuel pump 10 assumes a slug forming mode with first fuel flow control means 50 configured to fluidly connect chambers 106 and 146 with dump line 72, and second flow control means 200 configured to fluidly connect chambers 108 and 148 with fuel supply means 20 via supply line 34. The movable stop arms 152 and 154 are positioned to set the stroke of pistons 98 and 138 to the length desired for that particular cycle of the fuel injection system, and pre-metered slugs of fuel and timing fluid are formed. The first flow control means 50 is then configured to fluidly connect chambers 106 and 148 to the fuel supply means 20, and second flow control mens 200 is configured to fluidly connect chambers 108 and 148 to the common rails 220 and 230 respectively. The fluid pressure generated in the chambers 106 and 146 delivers the pre-metered slugs to the common rails during a slug delivery mode of the fuel pump 10.

Figure 2A:
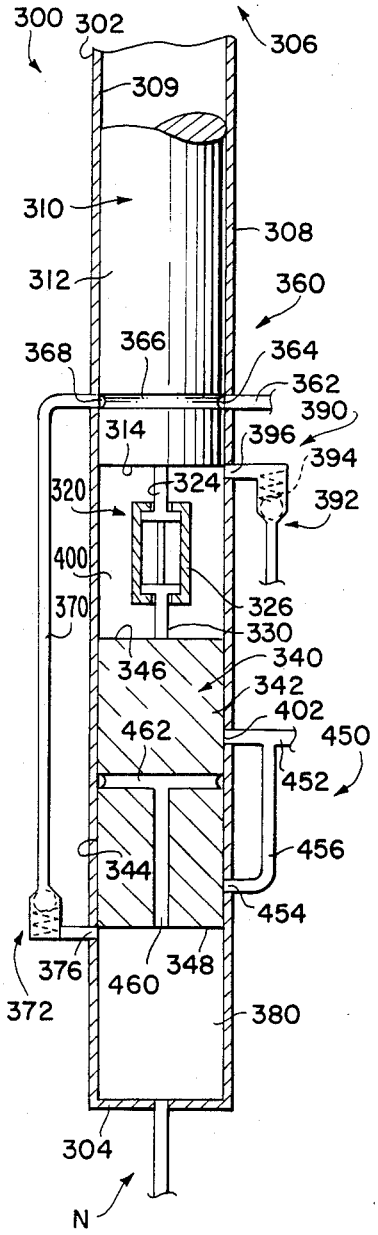
FIG. 2*a* is a cross-sectional schematic view of a unit injector used in the fuel injection system of FIG. 1 showing the unit injector in a fully retracted, fuel slug and timing fluid slug receiving mode.

The fuel injection system of the present invention further includes a plurality of unit injectors 300 associated with a corresponding number of engine cylinders of the internal combustion engine. Each unit injector is caused to operate in timed relation with the reciprocal movement of the engine piston located within the corresponding engine cylinder of the internal combustion engine to inject fuel into the associated combustion chamber in quantities and at times which are determined by engine operation and the size of the pre-metered slugs of fuel and timing fluid delivered by fuel pump 10. Each unit injector 300 is fluidly connected to the common rails 220 and 230 to receive pre-metered slugs of fuel and timing fluid from fuel pump 10. A unit injector 300 is shown in FIG. 2A as including a housing 302 having a first end 304 and a second end 306 connected together by a wall 308 and having an internal cavity 309 defined therein.

The unit injector 300 further includes an injection plunger 310 positioned in the internal cavity 309 of housing 302 and adapted to be reciprocated within that housing 302 in timed relation with the combustion engine by a suitable mechanical means (not shown). This mechanical means can include suitable cams, return springs and linkages to reciprocate injection plunger 310 toward and away from housing first end 304. The injection plunger 310 includes a side 312 and an end 314. A lost motion coupling 320 is mounted on end 314 of injection plunger 310, and includes a first mounting pin 324 on plunger end 314 and a yoke 326 loosely coupled to first mounting pin 324 to permit relative movement between yoke 326 and pin 324. A second mounting pin 330 is also loosely coupled to yoke 326 to be movable relative to that yoke.

A timing piston 340 is positioned in the internal cavity 309 of housing 302 for reciprocating movement within that housing toward and away from the housing first end 304. The timing piston 340 includes a body 342 having a side 344 and first and second ends 346 and 348. Lost motion coupling second pin 330 is affixed to timing piston first end 346 to couple timing piston 340 to injection plunger 310 via lost motion coupling 320. Lost motion coupling 320 is sized so that injection plunger 310 lifts timing piston 340 when that power plunger reaches a predetermined location in housing 302; however, initial movement of injection plunger 310 toward housing first end 304 will not be mechanically transmitted to timing piston 340.

Unit injector 300 further includes a fuel receiving means 360 fluidly connected to fuel common rail 220 to receive pre-metered fuel slugs therefrom when unit injector 300 is in a fuel receiving mode. Fuel receiving means 360 includes a fuel supply line 362 fluidly connected to fuel common rail 220, a fuel inlet port 364 defined in housing wall 308, a groove 366 defined in injection plunger body 312, a fuel outlet port 368 defined in housing wall 308 to be alignable with groove 366 to be fluidly connected to fuel supply line 362 via inlet port 364 when injection plunger 310 is located at a specified position within housing 302. When groove 366 is aligned with ports 364 and 368, as shown in FIG. 2A, the unit injector 300 is in a fuel receiving mode and can receive pre-metered fuel slugs from fuel pump 10.

The fuel receiving means 360 further includes a fuel transfer line 370 fluidly connected to fuel outlet port 368 and having a flow control valve 372 therein. A second fuel inlet port 376 is defined in housing wall 308, and fuel transfer line 370 is fluidly connected to that second fuel inlet port 376. Fuel receiving means 360 further includes a variable volume injection chamber 380 defined between timing piston second end 348 and housing first end 304. When unit injector 300 is in a fuel receiving mode, a pre-metered fuel slug is transferred from fuel common rail 220 to variable volume injection chamber 380. Reciprocating movement of injection plunger 310 periodically places unit injector 300 into and out of a fuel receiving mode for receiving and trapping pre-metered fuel slugs in chamber 380.

The unit injector 300 further includes a timing fluid receiving means 390 fluidly connected to timing fluid common rail 230 to receive a timing fluid slug after such timing fluid slug has been formed by fluid pump 10 and when unit injector 300 is in a timing fluid slug receiving mode. The pre-metered slug of timing fluid received by unit injector 300 is used to set the beginning of fuel injection into the combustion chamber associated with unit injector 300 according to the volume of such pre-metered slug of timing fluid. Timing fluid receiving means 390 includes a timing fluid supply line 392 fluidly connected to timing fluid common rail 230 and having a flow control valve 394 therein, a timing fluid inlet port 396 defined in housing wall 308 and a variable volume timing fluid chamber 400 defined between end 314 of injection plunger 310 and end 346 of timing piston 340, with lost motion coupling 320 being located in variable volume timing fluid chamber 400. Timing fluid receiving means 390 further includes a timing fluid outlet port 402 defined in housing wall 308 for releasing timing fluid from chamber 400 at the end of fuel injection.

The timing fluid located in variable volume timing fluid chamber 400 forms a hydraulic link between injection plunger 310 and timing piston 340. The length of this hydraulic link is determined by the volume of the pre-metered slug of timing fluid in relation to the dimensions of housing 308, and due to the nature of lost motion coupling 320, movement of injection plunger 310 toward housing end 304 will not be transmitted to timing piston 340 until injection plunger end 314 contacts the timing fluid located in timing fluid chamber 400 to be hydraulically linked to that timing piston 340. The timing of movement of injection plunger 310 can be set by adjusting the mechanical means associating injection plunger 310 with the combustion engine, and the beginning of fuel injection into the associated combustion chamber, hence the advance of unit injector 300, is controlled by the length of the hydraulic link existing between injection plunger end 314 and timing piston end 346 as the injection plunger 310 is coupled to the fuel in variable volume injection chamber 380 only via the hydraulic link and the timing piston 340.

As the volume of the pre-metered slug of timing fluid in chamber 400 is set by timing fluid slug forming means 130 and the associated adjustment control means 150 which is variable on a cycle-by-cycle basis, the beginning of fuel injection by unit injector 300 can be varied on a cycle-by-cycle basis by changing the volume of the pre-metered slugs of timing fluid delivered to unit injectors 300 by the fuel pump 10 via common rail 230. This variation of injection timing, therefore, does not depend on nozzle or orifice parameters, nor on complicated mechanical linkages in the fuel injection system unit injector, and can be carried out rapidly and acccurately. By increasing the volume of a pre-metered slug of timing fluid over the volume of another pre-metered slug of timing fluid, the beginning of injection is moved up accordingly.

A dump system 450 is associated with unit injector 300 to convey timing fluid and uninjected fuel back to a suitable collection means, such as reservoir R, if suitable. The dump system 450 includes a dump line 452 fluidly connecting outlet port 402 to the collection means, a port 454 defined in housing wall 308 and a conduit 456 connecting port 454 to dump line 452. Dump system 450 further includes a passage 460 extending axially of timing piston 340 and a groove 462 defined in timing piston 340 to intersect passage 460. When groove 462 is aligned with outlet port 454, there is a fluid path defined between chamber 380 and dump system dump line 452 for returning fuel to the collection means when unit injector 300 is in a return mode.

A fuel injection nozzle N is located in housing end 304 to fluidly connect fuel receiving means variable volume injection chamber 380 to the combustion chamber associated with unit injector 300. The nozzle N can be of any suitable construction and delivers fuel to that combustion chamber in quantities and at times set to be in properly timed relation to the combustion engine on a cycle-by-cycle basis by the volume of the pre-metered slugs of fuel and timing fluid delivered to unit injector 300 by fuel pump 10 when the unit injector 300 is in a fuel and timing fluid receiving mode.

Figure 2B:
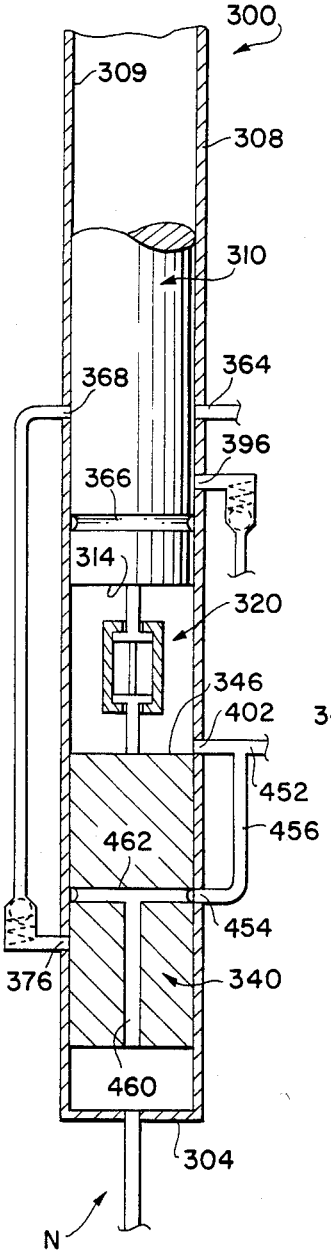
FIG. 2*b* is a cross-sectional schematic view of the FIG. 2*a* unit injector showing the injector at the end of an injection mode and at the beginning of a spill mode.
Figure 2C:
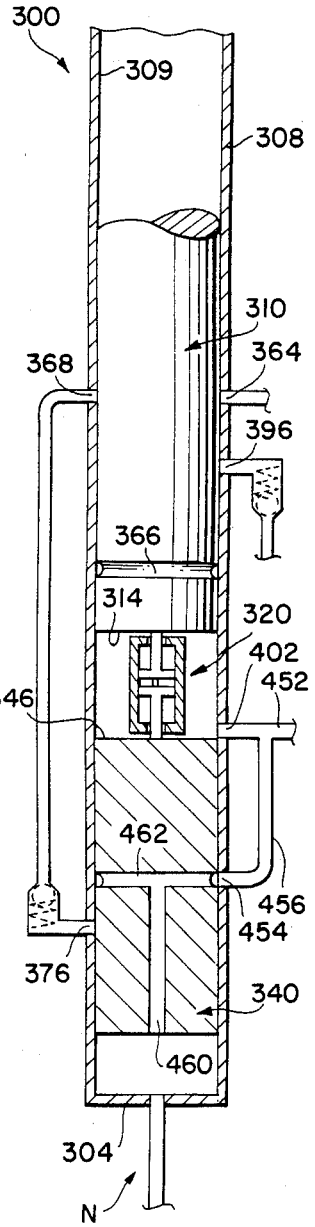
FIG. 2*c* is a cross-sectional schematic view of the FIG. 2*a* unit injector showing that injector at the end of the spill mode.

Operation of unit injector 300 can best be understood by comparing FIGS. 2A, 2B and 2C. Unit injector 300 is in a fully retracted fuel and timing fluid slug receiving mode in FIG. 2A with groove 366 aligned with fuel inlet port 364 and fuel outlet port 368 to define a fluid path between fuel slug common rail 220 and variable volume injection chamber 380 whereby a pre-metered fuel slug of a predetermined volume is transferred into chamber 380. When unit injector 300 is in the timing fluid slug receiving mode, timing fluid inlet port 396 is also open to define a flow path between variable volume timing chamber 400 and timing fluid slug common rail 230 whereby a pre-metered timing fluid slug of predetermined volume is transferred into the chamber 400. At a prescribed moment in engine operation, injection plunger 310 is mioved toward housing end 304 by the mechanical means linking unit injector 300 to the engine. This downward movement closes ports 364, 368 and 396 thereby taking the unit injector out of the fuel slug and timing fluid slug receiving mode and closing the chambers 380 and 400.

Downward movement of injection plunger 310 is not coupled to or transmitted to timing piston 340 until injection plunger end 314 contacts the timing fluid trapped in the chamber 400 whereby the timing advance of the injection plunger is set by the delay time between initial movement of the injection plunger toward housing end 304 under the influence of the mechanical moving means associated with unit injector 300, and initial contact betwen injection plunger end 314 and the timing fluid in chamber 400. This timing advance, or delay time, is thus determined entirely by the size of the pre-metered timing fluid slug and can be set by the control means associated with the fluid pump 10.

After contact between injection plunger end 314 and the timing fluid in chamber 400, further movement of injection plunger 310 is coupled to the fuel trapped in the chamber 380 via the hydraulic link defined by the timing fluid in chamber 400. Such injection plunger movement forces fuel out of nozzle N into the combustion chamber.

Injection continues until timing piston end 346 moves past outlet port 402 at which time, further downward movement of injection plunger 310 forces timing fluid into the dump system 450. This configuration is illustrated in FIG. 2B and can be termed a spill mode. The groove 462 is also aligned with outlet port 454 to spill fuel from chamber 380 into the dump system 450 as well.

After completion of spill, as indicated in FIG. 2C, injection plunger 310 will be moved back toward housing end 306 by the mechanical means associated with unit injector 300, and will mechanically move timing piston 340 back into the FIG. 2A fluid receiving mode via lost motion coupling 320 when that injection plunger 310 moves back to a predetermined location in housing 302 to move timing piston 340 into the FIG. 2A fluid receiving position when injection plunger 310 is the FIG. 2A fluid receiving piston to restart the cycle.

It is noted that because nearly 120° of crank motion are available for each cylinder of a six cylinder engine, and there is no reason to impede flow or generate high pressure in the present fuel injection system during the process forwarding pre-metered slugs to the unit injector, the volume of the fuel and timing fluid slugs received at each unit injector will be practically identical, on a cylinder-by-cylinder basis, to fuel and timing fluid slugs introduced into the fuel and timing fluid common rails 220 and 230 by fuel pump 10, despite the use of common rails rather than individual injector pipes.

Figure 3:
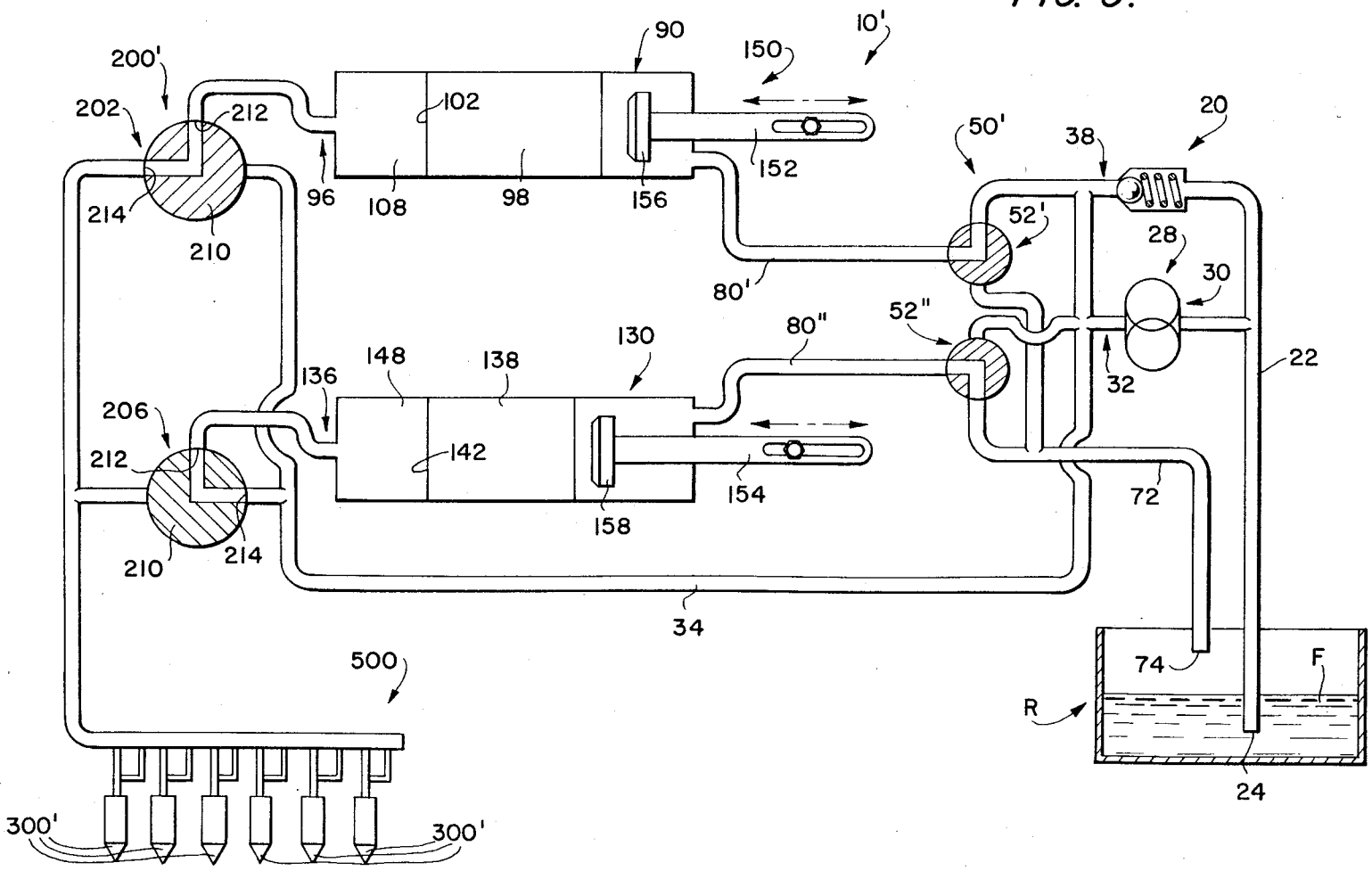
FIG. 3 is a schematic view of an alternative embodiment of the present invention including a pair of positive displacement pumps and a single common rail.
Figure 4A:
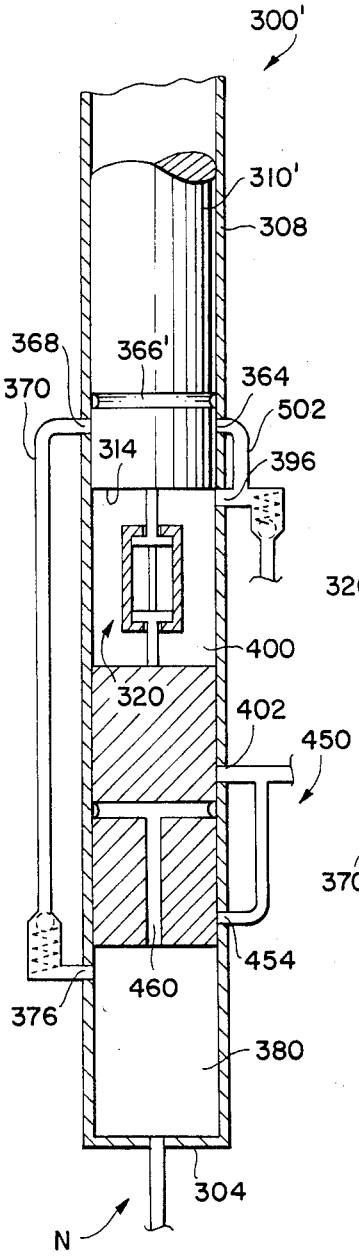
FIG. 4*a* is a cross-sectional schematic view of a unit injector used in the fuel injection system of FIG. 3 showing the unit injector in a fully retracted, timing fluid slug receiving mode.
Figure 4B:
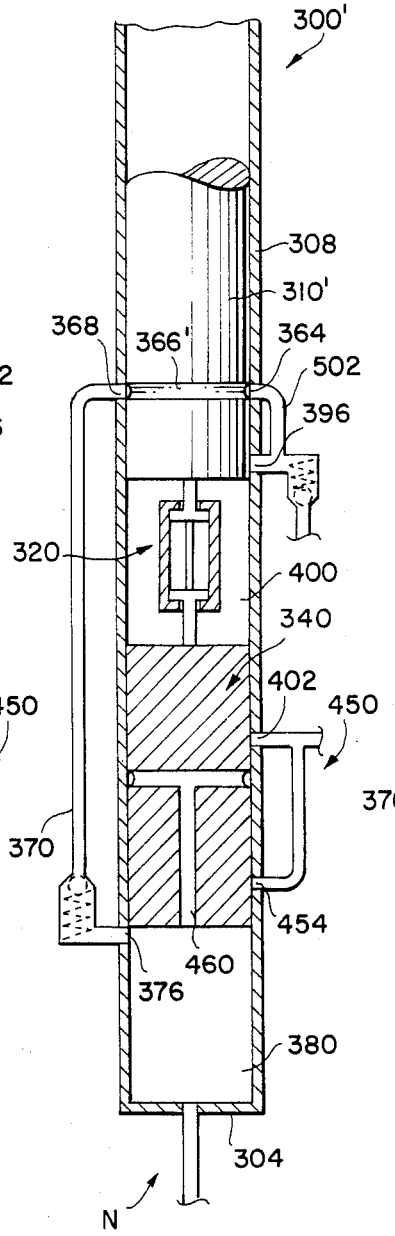
FIG. 4*b* is a cross-sectional schematic view of the FIG. 4*a* unit injector showing that injector in a fuel slug receiving mode.
Figure 4C:
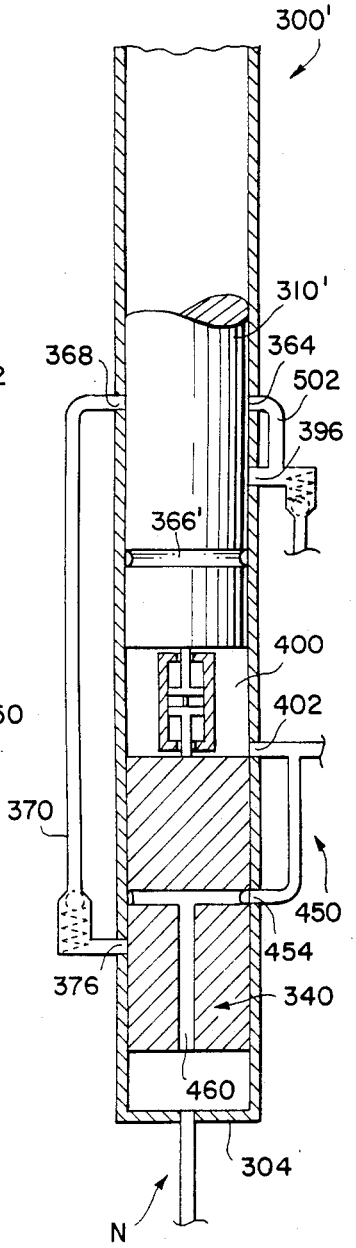
FIG. 4*c* is a cross-sectional schematic view of the FIG. 4*a* unit injector showing that injector at the end of the spill mode.

An alternative fuel injection system is shown in FIGS. 3 and 4A through 4C. The alternative fuel injection system is similar to the just-described fuel injection system, except that alternative fuel pump 10' includes one single common rail 500 in place of common rails 220 and 230. This alternative fuel pump 10' is thus a two-channel pump, whereas fuel pump 10 is a three-channel fuel pump. Use of one single common rail 500 requires modification of the first fuel control means from control means 50 which includes one valve body 52 to a control means 50' which includes two valve bodies 52' and 52'' and two conduits 80' and 80'' to properly control the positive displacement fuel slug forming means 90 and the positive displacement timing slug forming means 130 of fuel pump 10'. These valve bodies 52' and 52'' are operated with a phase difference to ensure that the slugs of fuel and timing fluid are forwarded at the correct, yet different, times to the common rail 500. As shown in FIG. 3, the common rail 500 is connected to both three way flow control valves 202 and 206 of second fuel flow control means 200' of fuel pump 10'.

The alternative fuel injection system includes a unit injector 300' which is similar to unit injector 300 except that unit injector 300' includes an injector plunger 310' having a groove 366' which is moved from the position of groove 366 in injection plunger 310 away from injection plunger end 314 so that groove 366' in injection plunger 310' is aligned with fuel inlet port 364 to establish a fuel slug receiving mode for injector 300' after lower injection plunger end 314 has moved past timing fluid inlet port 396 to close off that port. The unit injector 300' thus has a timing fluid slug receiving mode which is separate from and prior to the fuel slug receiving mode; whereas, unit injector 300 has a fuel slug receiving mode which occurs simultaneously with a timing fluid slug receiving mode. A conduit 502 connects fuel port 364 to timing fluid port 396 in injector 300' as a single common rail 500 is used for both fuel and timing fluid. A step cam of some sort is required to properly operate power plunger 310'.

INDUSTRIAL APPLICABILITY

While the fuel injection system disclosed herein is most useful in a compression combustion engine, it can be used in any combustion engine in which timing and quantity of fuel injection is important. The valve bodies 52, 52' 52'', 202 and 206 can be hydromechanical with ported stations of an engine-driven rotary valve shaft, or electrohydraulic, or the like. The position of movable stops 152 and 154 can be made a function of both engine speed and injected fuel quantity to provide optimum timing for all conditions of speed and load. The lost-motion coupling 320 can be of any suitable form, and dump system 450 is optional. The slug forming means 90 and 130 are disclosed as including single acting pistons, but double acting pistons are also usable, if suitable. Fuel pumps 10 and 10' can include any suitable control means and are adaptable to digital or analog control, electronic, hydromechanical, or pure mechanical control, as suitable. The unit injectors can be associated with the engine by a camshaft such that not more than one unit injector is in a fuel and/or timing fluid receiving mode at any one time so the unit injectors perform a valving/distributing and a pumping function while the fuel pump controls the amount of fuel metered and the injection advance by controlling the volume of the pre-metered slugs of fuel and timing fluid.

We claim:

1. A variable timing fuel injection system for intermittently injecting fuel into the combustion chamber of a cyclically operating internal combustion engine, comprising (a) fuel supply means for providing a supply of liquid fuel at low pressure and fuel slug forming means associated therewith (b) injector means adapted to be mounted adjacent the combustion chamber of the internal combustion engine and fluidically connected with fuel supply means for receiving fuel from said fuel supply means and for cyclically injecting fuel slugs under high pressure into the combustion chamber; said injector means including timing fluid receiving means for controlling the timing of fuel injection during engine operation in dependence upon the volume of timing fluid slugs received by said injector means; and (c) timing slug forming means adapted to be mounted remote from said injector means for metering slugs of timing fluid and for delivering each premetered slug of timing fluid to said injector means prior to the commencement of injection of fuel whose timing is to be controlled wherein said fuel supply means comprises pump means and said slug forming means comprise slug size control means for controlling the pump means to set the size of said timing and fuel slugs, wherein said slug size control means includes a fuel piston associated with said fuel slug forming means for forming and delivering the fuel slugs and a timing fluid piston associated with said timing slug forming means for forming and delivering the timing slugs, first movable stop means for controlling movement of said fuel piston and setting the size of the fuel slugs formed thereby, second stop means for controlling movement of said timing fluid piston and setting the size of the fuel slugs formed thereby and adjustment means for controlling each of said movable stop means on a cycle-by-cycle basis.

2. A positive displacement fuel injection system for use with an internal combustion engine having at least one combustion chamber, comprising:

a fuel pump including a fuel slug forming means for metering slugs of fuel and a timing slug forming means for metering slugs of timing fluid; and a unit injector associated with the combustion chamber to operate in timed relation with the internal combustion engine to periodically assume a slug receiving configuration in accordance with timing of engine operation and having a fuel receiving means fluidly connected to said fuel slug forming means to receive a pre-metered slug of fuel when said unit injector is in a fuel slug receiving mode and deliver fuel to the combustion chamber in timed relation to engine operation, and timing fluid receiving means fluidly connected to said timing slug forming means to receive a pre-metered slug of timing fluid when said unit injector is in a timing fluid slug receiving mode with the amount of fuel injected into an associated combustion chamber by said unit injector and the timing of that injection on a cycle-by-cycle basis being a function of the volume of said pre-metered slugs received by said unit injector in each cycle, wherein said timing slug and fuel slug forming means each includes a slug size control means to set the size of said timing and fuel slugs delivered by said fuel pump, wherein said slug size control means includes a fuel piston associated with said fuel slug forming means for forming and delivering the fuel slugs and a timing fluid piston associated with said timing slug forming means for forming and delivering the timing slugs, first movable stop means for controlling movement of said fuel piston and setting the size of the fuel slugs formed thereby, second stop means for controlling movement of said timing fluid piston and setting the size of the fuel slugs formed thereby and adjustment means for controlling each of said movable stop means on a cycle-by-cycle basis.

3. The positive displacement fuel injection system as defined in claim 2, wherein the internal combustion engine includes a plurality of combustion chambers, and the fuel injection system includes a plurality of said unit injectors, each of said unit injector being associated with a combustion chamber, and further includes a first conduit fluidically connecting said fuel slug forming means with each of said plurality of unit injectors, only one said unit injector out of said plurality of unit injectors operating in a fuel slug receiving mode at any one time.

4. The positive displacement fuel injection system defined in claim 3 further including a second conduit fluidly connecting said timing slug forming means with each of said plurality of unit injectors, only one said unit injector out of said plurality of unit injectors operating in a timing slug receiving mode at any one time.

5. The positive displacement fuel injection system for use with an internal combustion engine having at least one combustion chamber, comprising:

a fuel pump including a fuel slug forming means for metering slugs of fuel and a timing slug forming means for metering slugs of timing fluid; and a unit injector associated with the combustion chamber to operate in timed relation with the internal combustion engine to periodically assume a slug receiving configuration in accordance with timing of engine operation and having a fuel receiving means fluidly connected to said fuel slug forming means to receive a pre-metered slug of fuel when said unit injector is in a fuel slug receiving mode and deliver fuel to the combustion chamber in timed relation to engine operation, and timing fluid receiving means fluidly connected to said timing slug forming means to receive a pre-metered slug of timing fluid when said unit injector is in a timing fluid slug receiving mode with the amount of fuel injected into an associated combustion chamber by said unit injector and the timing function of the volume of said pre-metered slugs received by said unit injector in each cycle, wherein said unit injector includes a housing containing an internal cavity and an injection nozzle fluidically connecting the internal cavity with the combustion chamber; a cam operated injection plunger mounted for reciprocal movement within said internal cavity, a timing piston mounted for reciprocal movement with said internal cavity between said injection plunger and said injection nozzle to form a variable volume timing chamber between said injection plunger and said timing piston and to form a variable volume injection chamber between said injection nozzle and said timing piston and a lost-motion coupler connecting said injection plunger to said timing piston in a manner causing the injection plunger to lift the timing piston after the injection plunger is retracted to a predetermined position within the housing and enabling the injection plunger to be returned in an opposite direction without mechanically transmitting said return movement to the timing piston.

6. The positive displacement fuel injection system defined in claim 5, wherein said housing contains a fuel supply port communicating with said internal cavity, and said cam operated injection plunger includes a fuel pasage alignable with said fuel supply port when said unit injection is in its fuel slug receiving mode to provide a pathway for fuel into said injection chamber.

7. The positive displacement fuel injection system defined in claim 6, wherein said housing contains a timing port communicating with said internal cavity, and each said unit injection assumes its timing slug receiving mode when said injector plunger moves to a position in which said timing fluid supply port is in communication with said variable volume timing chamber.

8. A positive displacement fuel injection system as defined in claim 7, wherein said housing contains a pair of dump ports in communication with said internal cavity, said first and second dump ports being positioned to communicate with said variable volume injection chamber and said variable volume timing chamber when said unit injector reaches the end of a fuel injection event.

9. The positive displacement fuel injection system defined in claim 4 further includes a fuel supply means for providing a supply of liquid fuel and a first three way flow control valve connected with said first conduit, said fuel slug forming means and said fuel supply means, said first three way control valve operating in a fuel slug metering mode in which the fuel supply means is fluidically connected with said fuel slug forming means and a fuel slug delivery mode in which the fuel slug forming means is fluidically connected with said first conduit.

10. The positive displacement fuel injection system defined in claim 9 wherein said timing fluid is the engine fuel and further including a second three way flow control valve connected with said second conduit, said timing slug forming means and said fuel supply means, said second three way control valve operating in a timing slug metering mode in which the fuel supply means is fluidically connected with said timing slug forming means and a timing slug delivery mode in which the timing fluid slug forming means is fluidically connected with said second conduit.

11. The positive displacement fuel injection system defined in claim 3, wherein said first conduit is also connected with said timing slug forming means, the timing slug receiving modes and the fuel slug receiving modes of all unit injectors connected with said first conduit occurring at distinct non-overlapping time periods.

* * * * *

UNITED STATES PATENT AND TRADEMARK OFFICE

CERTIFICATE OF CORRECTION

PATENT NO. : 4,621,605

DATED : November 11, 1986

INVENTOR(S) : ALFRED W. CAREY, JR.; and LESTER L. PETERS

It is certified that error appears in the above-identified patent and that said Letters Patent is hereby corrected as shown below:

In column 13, line 64, between the words "timing" and "function" insert: -- of that injection on a cycle-by-cycle basis being a --.

Signed and Sealed this

Eighteenth Day of August, 1987

*Attest:*

*Attesting Officer*

DONALD J. QUIGG

*Commissioner of Patents and Trademarks*